United States Patent [19]

Barnett et al.

[11] Patent Number: 4,951,755

[45] Date of Patent: Aug. 28, 1990

[54] MANUAL ACTUATOR

[75] Inventors: Charles B. Barnett, Akron; Charles H. Riedy, Lakewood, both of Ohio

[73] Assignee: Automatic Sprinkler Corporation of America, Cleveland, Ohio

[21] Appl. No.: 401,182

[22] Filed: Aug. 31, 1989

[51] Int. Cl.[5] ..... A62C 35/00; A62C 35/02; A62C 37/14

[52] U.S. Cl. ..... 169/26; 169/38

[58] Field of Search ..... 169/26, 54, 56–58, 169/37–40, 62, 30, 71, 19

[56] References Cited

U.S. PATENT DOCUMENTS

| | | | |
|---|---|---|---|
| 466,658 | 1/1872 | Cumnock et al. | 169/37 |
| 2,374,686 | 5/1945 | Knight | 169/39 |
| 3,279,262 | 10/1966 | Olson | 169/26 X |
| 3,378,081 | 4/1968 | O'Reilly | 169/19 |
| 3,392,787 | 7/1968 | Weise | 169/26 |
| 3,463,236 | 8/1969 | Flajole et al. | 169/26 X |
| 3,543,211 | 11/1970 | Dahl | 169/38 X |
| 3,613,793 | 10/1971 | Huthsing, Jr. | 169/26 |
| 3,754,602 | 8/1973 | Magdars | 169/26 X |
| 3,797,746 | 3/1974 | Gray et al. | 169/37 X |
| 3,811,511 | 5/1974 | McCulloch | 169/58 X |
| 3,820,607 | 6/1974 | Miley | 169/58 |
| 4,854,388 | 8/1989 | Wyatt | 169/26 |

FOREIGN PATENT DOCUMENTS

| | | | |
|---|---|---|---|
| 278902 | 8/1988 | European Pat. Off. | 169/26 |
| 795232 | 3/1936 | France | 169/38 |
| 670875 | 7/1989 | Switzerland | 169/56 |
| 1359857 | 7/1974 | United Kingdom | 169/38 |
| 2076652 | 12/1981 | United Kingdom | 169/57 |

OTHER PUBLICATIONS

Fireboy Automatic Halon 1301 System Owner's Manual, Installation Instructions for MA Models, 1983.

*Primary Examiner*—Joseph F. Peters, Jr.
*Assistant Examiner*—James M. Kannofsky
*Attorney, Agent, or Firm*—Jones, Day, Reavis & Pogue

[57] ABSTRACT

A manual actuator comprised of a mounting means, a lever and an arm. The mounting means is adapted for field mounting, as well as for factory mounting, on the fire extinguisher in the proximity of the automatic actuator, without requiring removal of any parts of the automatic fire extinguisher. The lever is attached to the mounting means and is capable of rotating, or pivoting, from left to right or from right to left about the point on the mounting means to which it is attached. The arm may be connected on one end to the lever. When installing the manual actuator, the arm may be positioned on either side of the trigger element of the automatic actuator to permit manual actuation from either the left or right hand side of the fire extingusher, according to the particular positioning needs of the place in which the fire extinguisher is placed. In addition, the lever may be attached to a means to pivot the lever in order to permit remote manual actuation.

9 Claims, 3 Drawing Sheets

MANUAL ACTUATOR

FIELD OF THE INVENTION

This invention pertains to manual actuators for automatic fire extinguishers. More particularly, it pertains to a manual actuator which may be readily field-installed for manual actuation from either side of the fire extinguisher.

BACKGROUND

Automatic fire extinguishers generally are comprised of a container for fire extinguishing material (or "extinguishant") which may be mounted by means of a housing on a wall or other suitable place. The container is typically cylindrical in shape and tapers in at the top. There is a manifold at the top of the container into which an automatic actuator may be engaged. The extinguishant in the container is kept under pressure. Inert chemicals such as halon are typically used for the extinguishant.

The automatic actuator closes off the manifold of the fire extinguisher. The automatic actuator may be similar in design to an automatic sprinkler head for an automatic sprinkler system. The automatic actuator is usually comprised of a body which is exteriorly threaded for engagement with the manifold of the container. The body of the automatic actuator has a passageway for the extinguishant. The passageway is sealed off by a closure element, or plug. A frame with two arms extends outward from the body and joins opposite the passageway. A deflector plate is attached to the frame opposite the passageway. A trigger element, such as a thermally responsive glass bulb or heat fused solder element, holds the closure element closed. The trigger element is designed to break, or fracture, at a predetermined temperature. When the trigger element breaks, the closing force exerted on the closure element is removed, and the closure element is pushed away from the passageway by the force of the pressurized extinguishant in the container.

In addition to automatic actuation, it is useful for an automatic fire extinguisher to be capable of manual actuation because there may be circumstances in which the need for the fire extinguisher arises before the heat-sensitive automatic actuator has triggered. Such circumstances may be caused, for example, if the fire extinguisher is for some reason shielded from the fire, or if it is too far from the fire to be automatically actuated. Hence, automatic fire extinguishers are sometimes equipped with manual actuators, in addition to automatic actuators.

Manual actuators which may be factory-installed on automatic fire extinguishers are known in the art. For example, lever arm and hoop arrangements, lever pull-arms and other types of cable and/or lever arrangements have been used for manual actuation systems. At least some of these designs, however, have used a part which wraps around the trigger element of the automatic actuator, which may shield the trigger element from its surroundings and thereby result in decreased responsiveness of the automatic actuator. Moreover, there is a need for manual actuators which may be readily field-installed by an owner or user of an automatic fire extinguisher, since many automatic fire extinguishers are not equipped with manual actuators at the factory. An owner of an automatic fire extinguisher that is not equipped with a manual actuator may find it preferable and cheaper to simply add a manual actuator to his or her automatic fire extinguisher, rather than obtain a new fire extinguisher that comes from the factory so equipped.

While prior art manual actuators may theoretically be capable of field installation, such installation may be carried out only with difficulty and, in some instances, only by removing or redesigning parts of the automatic fire extinguisher. To be effective, however, field installation, or field mounting, should be able to be accomplished in a matter of minutes and without removing or redesigning parts of the automatic fire extinguisher. Otherwise, the owner or user of an automatic fire extinguisher may be deterred from installing a manual actuator because of the excessive complexity and time that may be required to mount or install a manual actuator on the fire extinguisher. Hence, the terms "field installation" or "field mounting", as used herein, refer to the ability to mount the manual actuator on the fire extinguisher in a matter of minutes, without removing or redesigning parts of the fire extinguisher.

In addition, manual actuators known in the art have not always been easily adaptable to the particular positioning needs of the place in which the fire extinguisher is to be used. For example, various manual actuators known in the art may be installed at the factory for actuation from the right hand side of the extinguisher, or, alternatively, may be installed for actuation from the left hand side of the extinguisher. However, if the extinguisher is to be placed in a narrow or otherwise tight space, it may be that the extinguisher can be manually actuated only from the side opposite that from which the extinguisher was designed to be manually actuated. While the cylinder of the fire extinguisher may be rotated to avert this problem, such rotation may result in the fire extinguisher being positioned in a direction which does not generate the optimum spray pattern. Hence, it is useful for a manual actuator to be capable of ready adaptation for actuation from either side of the automatic fire extinguisher, without having to change the direction in which the fire extinguisher is pointed.

SUMMARY OF THE INVENTION

It is an object of the present invention to provide a manual actuator which may be readily field-installed, or mounted, on a fire extinguisher in the field, as well as at the factory, and which is readily adaptable for actuation from either side of the fire extinguisher, according to the particular positioning needs of the place in which the fire extinguisher is placed. A manual actuator according to the present invention is comprised of a mounting means, a lever and an arm. The mounting means is adapted for field mounting on the fire extinguisher in the proximity of the automatic actuator, without requiring removal of any parts of the automatic fire extinguisher. The lever is attached to the mounting means and is capable of rotating, or pivoting, from left to right or from right to left about the point on the mounting means to which it is attached. The arm may be connected on one end to the lever. When installing the manual actuator, the arm may be positioned on either side of the trigger element of the automatic actuator to permit manual actuation from either the left or right hand side of the fire extinguisher. In addition, the lever may be attached to a means to pivot the lever in order to permit remote manual actuation.

BRIEF DESCRIPTION OF THE DRAWINGS

The invention is explained in more detail below with reference to the drawings, in which.

DESCRIPTION OF PREFERRED EMBODIMENT

Figure 1:
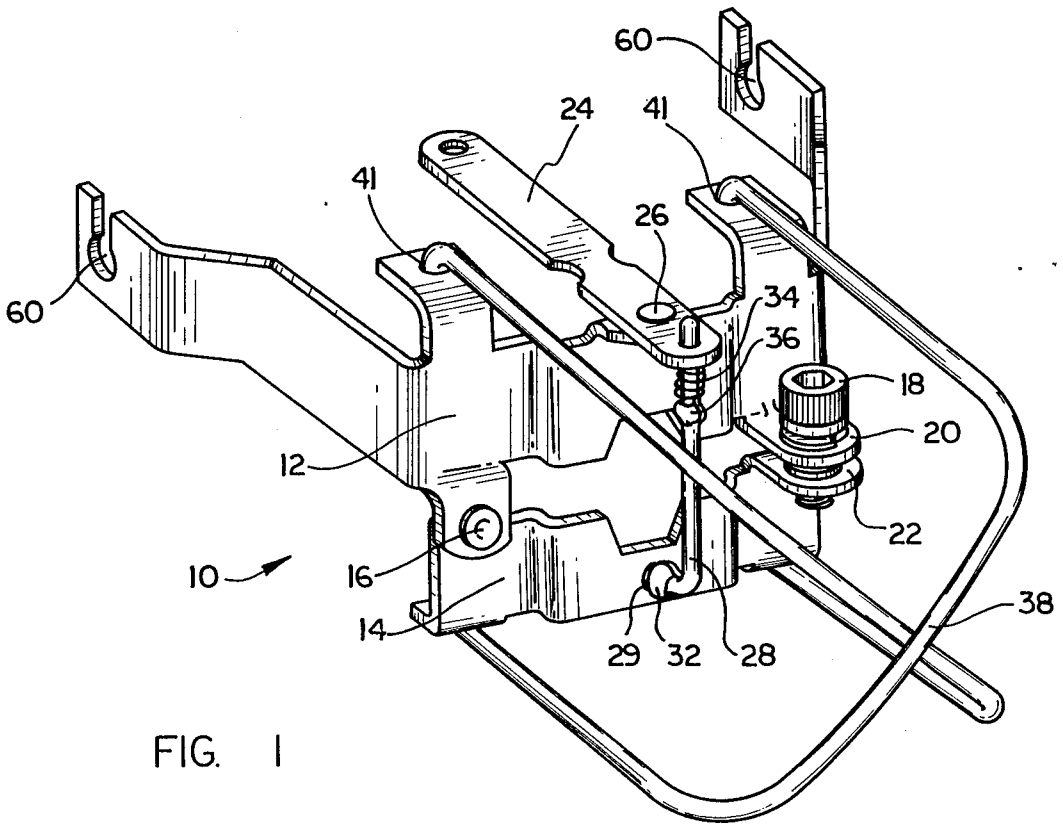
FIG. 1 is a perspective view of a manual actuator according to the present invention.

As shown in FIG. 1, the manual actuator 10 is comprised of a mounting means having an upper bracket 12 and a lower bracket 14. The upper bracket 12 and lower bracket 14 are secured to each other on one side by a fastening means, in this case a rivet 16, and are secured on the other side by another fastening means, in this case a screw 18. The screw 18 is inserted into a clearance hole 20 on the upper bracket 12 and screwed into a lip 22 on the lower bracket 14. A lever 24 is operatively attached to the upper bracket 12 by another fastening means—here, a rivet 26. The lever 24 may rotate, or pivot, about the rivet 26 from either left to right or right to left. In the mounted manual actuator, the pivotal movement of the lever 24 about the point on the mounting means to which the lever 24 is attached occurs in a plane which is parallel to the trigger element 46 of the automatic actuator.

Figure 2:
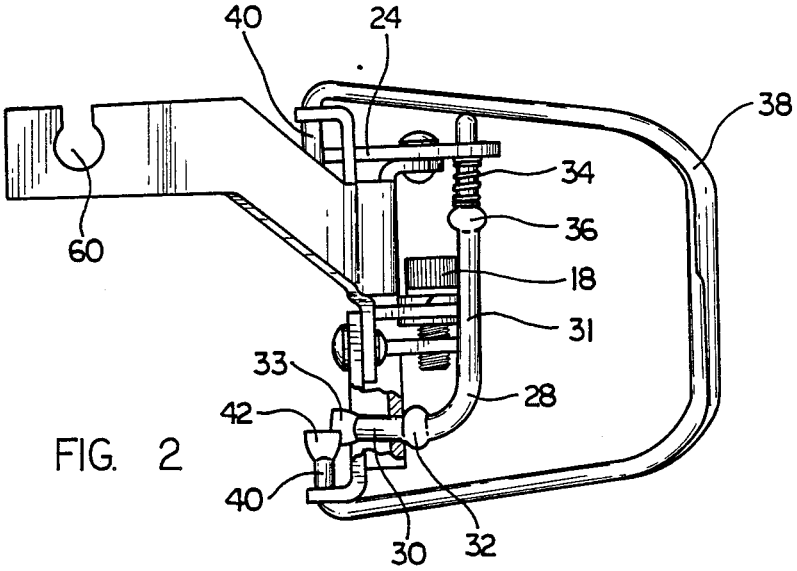
FIG. 2 is a side elevational view of the manual actuator illustrated in FIG. 1.

An L-shaped arm 28 extends from a hole 29 in the lower bracket 14, into which the short leg 30 of the arm 28 has been inserted. The other end of the arm 28 is connected to the lever 24 by having been positioned through a hole 50 in one end of the lever 24. The long leg 31 of the arm 28 is perpendicular to the lever 24. On both sides of the hole 29 in the lower bracket 14 into which the short leg 30 of the arm 28 has been inserted, the arm 28 has been flattened to form dimples 32 and 33. The dimple 32 shown in FIG. 1 prevents the arm 28 from slipping too far into the hole 29 in the lower bracket 14, thus helping to minimize the amount of "play" in the arm 28. The dimple 33 shown in FIG. 2 prevents the arm 28 from slipping out of the hole in the lower bracket 14. A spring 34 is positioned around the arm 28 in between the lever 24 and a third dimple 36 on the arm 28. The spring 34 is compressed and serves to further minimize play in the arm 28.

Figure 3:
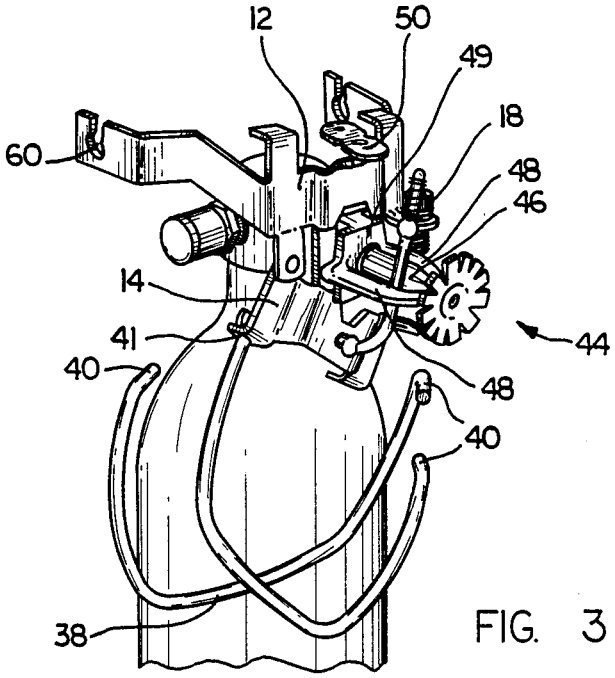
FIG. 3 is a perspective view of a manual actuator according to the present invention which is partially mounted on an automatic actuator on a fire extinguisher.

A guard 38 extends from the upper bracket 12 and lower bracket 14. The guard 38 is attached to the mounting means of the manual actuator 10 by insertion of its four prongs 40 into holes 41 in the upper bracket 12 and lower bracket 14. Three of the prongs 40 may be easily removed from the holes 41, which is required in order to mount the mounting means on a fire extinguisher, as shown in FIG. 3. One prong 40, however, has been flattened on its end after insertion into a hole in the lower bracket 14, forming a dimple 42 on the end of the prong 40. The dimple 42 prevents the prong 40 from becoming detached from the lower bracket 14, so that the guard 38 does not become misplaced or lost. Thus, the guard 38 is partially detachable from the mounting means. When in place in a mounted manual actuator 10, the guard 38 extends from the mounting means to beyond the automatic actuator 44 and thereby helps to prevent accidental actuation of the fire extinguisher by an object bumping into or hitting the arm 28 of the manual actuator 10 or the glass bulb trigger element 46 of the automatic actuator 44. The manual actuator is operable, however, without the guard.

The manual actuator 10 shown in FIG. 3 is partially mounted on the automatic actuator 44 of a fire extinguisher. The screw 18 which in FIG. 1 holds the upper bracket 12 and lower bracket 14 together on one side, is unscrewed from the lip 22 on the lower bracket 14, and the upper bracket 12 and lower bracket 14 are swung apart on that side. The guard 38 is hanging free, only one prong being attached to the lower bracket 14 of the mounting means. Thus, simply by partially detaching the guard 38, and swinging the upper bracket 12 and lower bracket 14 apart on one side, the mounting means has been mounted on the body of the automatic actuator 44, without removing the trigger element or any other part of the automatic fire extinguisher. The arm 28 has been positioned between, and perpendicular to, the glass bulb trigger element 46 and one of the frame arms 48 of an automatic actuator 44. To complete assembly of the manual actuator 10 onto the automatic actuator 44 of the fire extinguisher, the lower bracket 14 would be swung up and secured to the upper bracket 12 by the screw 18, thus securing the mounting means to the body 49 of the automatic actuator 44. In swinging the lower bracket 14 up, the arm 28 would be positioned through the hole 50 in the lever 24, thereby connecting the arm 28 to the lever 24. The upper bracket 12 and lower bracket 14 fit in a slot in the body 49 of the automatic actuator 44.

Figure 4:
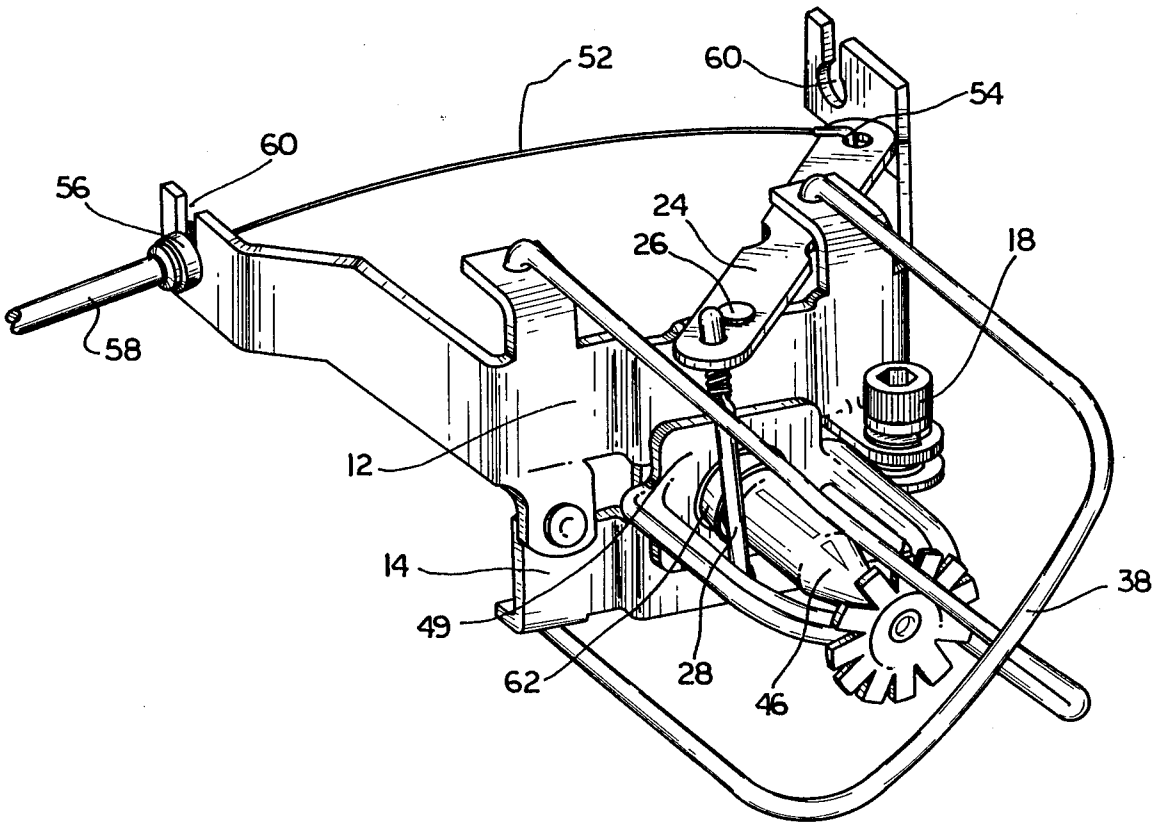
FIG. 4 is a perspective view of a manual actuator according to the present invention which has been mounted on an automatic actuator of a fire extinguisher and attached to a cable for remote actuation.

FIG. 4 shows a manual actuator 10 according to the present invention which has been mounted, and in which the lever 24 has been attached to a means to pivot the lever 24 to permit remote manual actuation. Here, the means to pivot the lever 24 is a cable 52. The arm 28 of the manual actuator 10, it may be noted, does not wrap around the glass bulb trigger element 46 or otherwise shield it from the environment. The guard 38 extends from the mounting means to beyond the automatic actuator 44. The lever 24 of the mounted manual actuator 10 is attached to the cable 52 by an S-hook 54. The end-fitting 56 of the cable housing 58 is inserted into a securing means for the cable. The securing means for the cable is a keyhole- shaped slot 60 in the upper bracket 12. There is a keyhole-shaped slot 60 on each side of the upper bracket 12.

Referring to FIG. 4, it may be seen that the manual actuator 10 could be attached to an oppositely disposed cable—running from the direction opposite the cable 52 shown in FIG. 4—simply by positioning the arm 28 on the other side of the trigger element 46 of the automatic actuator 44, and appropriately pivoting the lever 24, during the mounting process. If the manual actuator 10 shown in FIG. 4 had been so mounted, preparation for remote manual actuation would be completed by attachment of the lever 24 to a cable approaching from the side opposite the cable 52 shown in FIG. 4, which cable would be secured by the keyhole-shaped slot 60 oppositely disposed to the slot 60 which is used in FIG. 4. Thus, a manual actuator according to the present invention may be mounted in the field to suit the particular positioning needs of both the fire extinguisher to which it is mounted and the cable which is used for remote manual actuation.

When the cable 52 attached to the lever 24 of the manual actuator 10 shown in FIG. 4 is pulled, the lever 24 will rotate, or pivot, about the rivet 26, or, in other words, about the point on the mounting means to which the lever 24 is attached. This, in turn, causes the arm 28 to swing across and break the glass bulb trigger element 46, thereby releasing the closing force on the closure element 62 of the automatic actuator 44. Thus, the lever 24 which rotates about the rivet 26 achieves a mechanical advantage through its lever-and-fulcrum design. When the closing force on the closure element is removed, the pressurized extinguishant in the fire extinguisher forces the closure element 62 away from the body 49 of the automatic actuator 44, thus allowing the extinguishant to flow out of the fire extinguisher.

What is claimed is:

1. A manual actuator for an automatic fire extinguisher comprising:

a mounting means adapted for field mounting on a fire extinguisher in the proximity of an automatic actuator on the fire extinguisher;

a lever attached to said mounting means, said lever being capable of pivoting about the point to which it is attached on the mounting means; and an arm connected on one end to said lever, said arm being capable of being positioned between and perpendicularly to a trigger element and frame arm of an automatic actuator of the fire extinguisher.

2. A manual actuator in accordance with claim 1 wherein the mounting means has two oppositely disposed securing means for oppositely disposed means to pivot the lever, and wherein the lever and the arm may be positioned to permit attachment of said lever to, and remote manual actuation by use of, one of said means to pivot the lever; or, alternatively, said lever and said arm may be positioned to permit attachment of the lever to, and remote manual actuation by use of, the oppositely disposed means to pivot the lever.

3. A manual actuator in accordance with claim 2 wherein the means to pivot the lever are cables.

4. A manual actuator in accordance with claim 3 wherein the securing means are keyhole-shaped slots.

5. A manual actuator in accordance with claims 1, 2, 3 or 4 wherein the mounting means comprises an upper bracket and lower bracket, said upper and lower brackets being capable of being secured to each other on one side.

6. A manual actuator in accordance with claim 5 wherein the arm is L-shaped.

7. A manual actuator in accordance with claims 6 further including a guard extending from the mounting means to beyond the automatic actuator when said mounting means is mounted.

8. A manual actuator in accordance with claim 7 wherein the guard is at least partially detachable from the mounting means.

9. A manual actuator for an automatic fire extinguisher having an automatic actuator attached thereto, comprising:

a mounting means adapted to be secured to the body of an automatic actuator without removing the trigger element of the automatic actuator;

a lever operatively attached to said mounting means and adapted for pivotal movement about a point on said mounting means;

an arm connected to said lever, said arm being capable of being positioned between a trigger element of an automatic actuator and a frame arm of an automatic actuator; and said mounting means having two oppositely disposed securing means for oppositely disposed means to pivot the lever, such that said lever and said arm may be positioned to permit attachment of the lever to the means to pivot the lever, thereby permitting remote manual actuation through use of the mean to pivot the lever.

* * * * *